US005673065A

United States Patent [19]

DeLeeuw

[11] Patent Number: 5,673,065

[45] Date of Patent: Sep. 30, 1997

[54] COLOR REDUCTION AND CONVERSION USING AN ORDINAL LOOKUP TABLE

[75] Inventor: William C. DeLeeuw, Hillsboro, Oreg.

[73] Assignee: Intel Corporation, Santa Clara, Calif.

[21] Appl. No.: 581,459

[22] Filed: Dec. 29, 1995

[51] Int. Cl.[6] ..... B09G 5/04

[52] U.S. Cl. ..... 345/153; 345/150; 345/152; 345/154; 345/155; 345/199; 395/131

[58] Field of Search ..... 345/153, 154, 345/155, 152, 150, 199; 395/131

[56] References Cited

U.S. PATENT DOCUMENTS

| | | | |
|---|---|---|---|
| 4,743,959 | 5/1988 | Frederiksen | 358/11 |
| 4,775,858 | 10/1988 | Stapleton et al. | 340/724 |
| 4,857,992 | 8/1989 | Richards | 358/13 |
| 4,991,122 | 2/1991 | Sanders | 364/521 |
| 5,003,299 | 3/1991 | Batson et al. | 340/703 |
| 5,068,644 | 11/1991 | Batson et al. | 340/701 |
| 5,124,688 | 6/1992 | Rumball | 340/703 |
| 5,138,303 | 8/1992 | Rupel | 340/703 |
| 5,142,273 | 8/1992 | Wobermin | 340/703 |
| 5,204,664 | 4/1993 | Hamakawa | 340/703 |
| 5,204,665 | 4/1993 | Bollman et al. | 340/703 |
| 5,218,431 | 6/1993 | Gleicher et al. | 358/13 |
| 5,218,432 | 6/1993 | Wakeland | 358/22 |
| 5,220,410 | 6/1993 | Wakeland et al. | 358/13 |
| 5,228,126 | 7/1993 | Marianetti, II | 395/162 |
| 5,233,684 | 8/1993 | Ulichney | 395/131 |
| 5,258,826 | 11/1993 | Wakeland et al. | 358/12 |
| 5,329,292 | 7/1994 | Nishioka et al. | 345/199 |
| 5,341,442 | 8/1994 | Barrett | 382/56 |
| 5,381,180 | 1/1995 | Keith | 348/396 |
| 5,384,582 | 1/1995 | Keith et al. | 345/199 |
| 5,406,310 | 4/1995 | Aschenbrenner et al. | 345/150 |
| 5,416,614 | 5/1995 | Crawford | 358/530 |
| 5,428,465 | 6/1995 | Kanamori et al. | 358/518 |
| 5,428,720 | 6/1995 | Adams, Jr. | 395/131 |
| 5,430,465 | 7/1995 | Sabella et al. | 345/199 |
| 5,450,098 | 9/1995 | Oz | 345/154 |
| 5,469,190 | 11/1995 | Masterson | 345/155 |

OTHER PUBLICATIONS

IBM Technical Disclosure Bulletin, vol. 37, No. 03, Mar. 1994 New York, US, pp. 95–96, XP 000441392 'Direct–to–Palette Dithering.'

IBM Technical Disclosure Bulletin, vol. 33, No. 5, Oct. 1990 New York, US, pp. 200–205, XP 000107434 'Default RGB Color Palette with Simple Conversion from YUV.'

IEEE Transactions on Consumer Electronics, vol. 37, Issue 3, Aug. 1991, pp. 182–189, "Single–Chip Video Processing System," by Hans–Jürgen Désor.

*Primary Examiner*—Kee M. Tung
*Assistant Examiner*—Vincent E. Kovalick
*Attorney, Agent, or Firm*—William H. Murray

[57] ABSTRACT

A color image signal is reduced and converted. Dithering the remainder is an embodiment. For example a pixel value is separated into its pixel components. Each component is further split into most-significant bit (MSB) and least-significant bit (LSB) parts. The MSBs from each component are combined to provide a color number. The color number is an index to a nearest-color map. Each entry in the nearest-color map is an index to a spectrum color palette having color entries. The spectrum color palette is an evenly divided spectrum of the colors displayable on an associated video display system. The particular color accessed in the color spectrum palette by the color palette is used for the pixel in the image being reduced and converted. In an embodiment, the LSBs of each color component are dithered. If the value of the LSBs of a color component are greater than a dither threshold value, a one is added to the MSBs of the color, prior to the MSB values being combined into the color number.

42 Claims, 5 Drawing Sheets

| | | | |
|---|---|---|---|
| A | B | C | D |
| E | F | G | H |
| I | J | K | L |
| M | N | O | P |

71

*FIG. 5a*

| | X1 | 2 | 3 | 4 | 5 | 6 | 7 | 8 | 9 | 10 | 11 | 12 | 13 | 14 | 15 | Xn |
|---|---|---|---|---|---|---|---|---|---|---|---|---|---|---|---|---|
| Y1 | A | B | C | D | A | B | C | D | A | B | C | D | | | | |
| 2 | E | F | G | H | E | F | G | H | E | F | G | H | | | | |
| 3 | I | J | K | L | I | J | K | L | I | J | K | L | | | | |
| 4 | M | N | O | P | M | N | O | P | M | N | O | P | | | | |
| 5 | A | B | C | D | | | | | | | | | | | | |
| 6 | E | F | G | H | | | | | | | | | | | | |
| 7 | I | J | K | L | | | | | | | | | | | | |
| 8 | M | N | O | P | | | | | | | | | | | | |
| 9 | A | | | | | | | | | | | | | | | |
| 10 | E | | | | | | | | | | | | | | | |
| 11 | I | | | | | | | | | | | | | | | |
| 12 | M | | | | | | | | | | | | | | | |
| 13 | A | | | | | | | | | | | | | | | |
| 14 | E | | | | | | | | | | | | | | | |
| 15 | I | | | | | | | | | | | | | | | |
| Yn | M | | | | | | | | | | | | | | | |

72

*FIG. 5b*

COLOR REDUCTION AND CONVERSION USING AN ORDINAL LOOKUP TABLE

BACKGROUND OF THE INVENTION

1. Field of the Invention

This invention relates to the field of video processing and display.

2. Description of the Related Art

There are a number of occasions where an image generated for display on one video system must be displayed on another, different type of video system. A typical example is in the applications sharing field where two or more computers share one or more applications. The shared application(s) typically reside on only one of the participating computers ("the host") but may receive input generated by and transmit output to one or more participating other computers ("the guest(s)"). The shared application(s) output display data typically is tailored for the host video display system, which might be capable of displaying more colors than one or more of the guest video systems. There are numerous other situations where high quality digital images must be displayed on a video system incapable of reproducing all of the colors of the original image.

When a color image is to be displayed on a video display system ("the target video system") capable of displaying fewer colors than those composing the original image, the colors in the image must reduced before it is displayed. Thresholding and dithering are two standard methods for modifying an image to reduce its number of colors to the number available on the target video system.

The thresholding method is a mathematical process which essentially replaces each color pixel from the source or original image with the closest color available on the target video system. Thresholding is slow and inaccurate. Images generated by the thresholding technique are generally poor replications of the original image.

Dithering is similar to thresholding and involves identifying and choosing between the two closest colors available on the target video system for each pixel in the image, according to a position-dependent threshold value. Which of the two possible colors for a pixel is ultimately selected depends on whether the pixel value exceeds the position-dependent threshold value. Dithering, though lossy, provides better image quality than thresholding, but dithering, like thresholding, requires significant amounts of processing time.

A system therefore is needed for limiting the loss of color detail of an image converted for display on a target video system having fewer colors than the color content of the image. Such a system would be particularly advantageous if the conversion occurred faster than thresholding or dithering conversions.

SUMMARY OF THE INVENTION

The invention converts a color image composed of color pixels. Components of the color pixels are received. Most-significant bits are truncated from the components. The truncated bits are combined to form a color number, which represents an index to a nearest-color map. The nearest-color map index is used to generate an index to a color palette, the color palette containing a plurality of colors. One of the plurality of colors in the color palette is accessed using the color palette index to represent the color pixel.

BRIEF DESCRIPTION OF THE DRAWINGS

The following detailed description will be more fully understood with reference to the drawings in which:

FIGS. 5*a* and 5*b* block diagrams showing the dither table and application of the dither table, which are part of an embodiment of the invention.

DETAILED DESCRIPTION OF THE PREFERRED EMBODIMENTS

Figure 1:
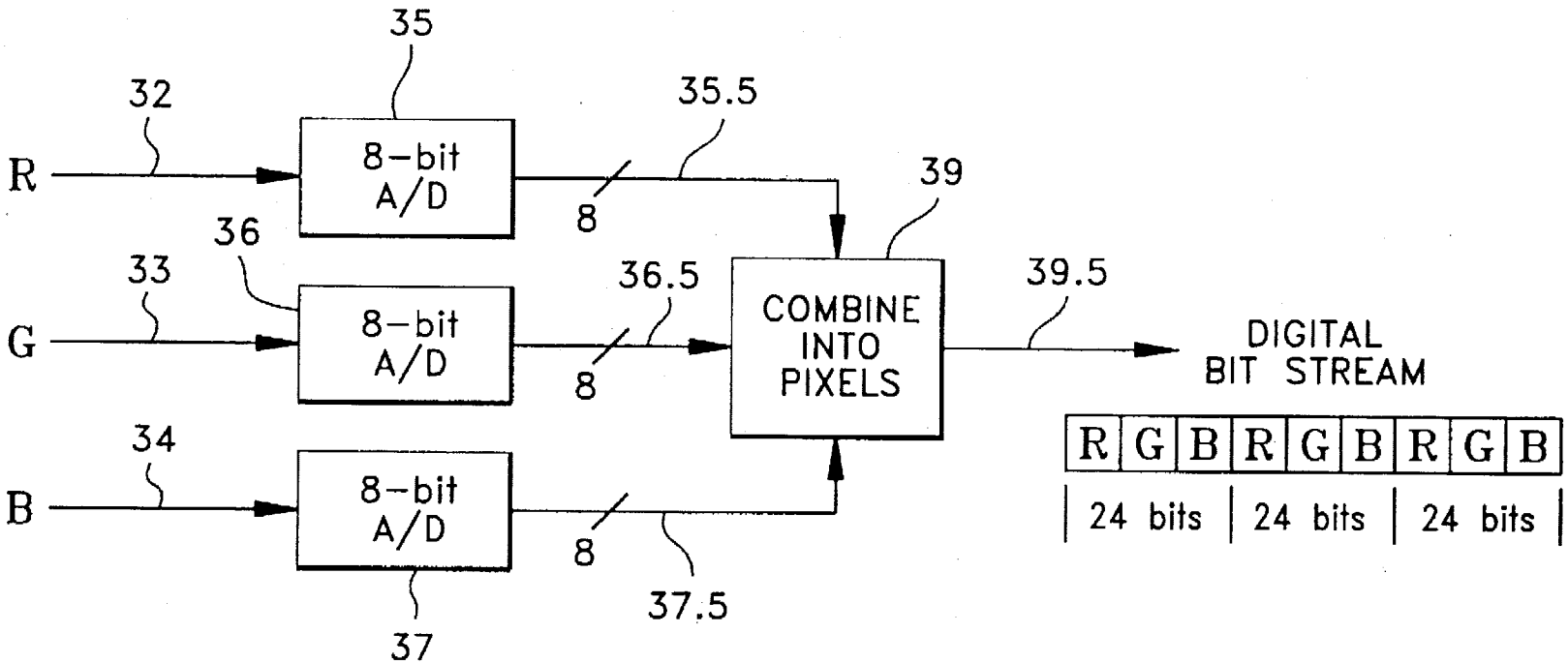
FIG. 1 is a block diagram of an RGB analog-to-digital converter.

A video system is often asked to display a color video signal which has more colors than the video system itself is capable of displaying. It is possible that a particular video system may simply be incapable of displaying all of the colors present in, for example, a digitally encoded RGB color signal. For example, referring now to FIG. 1, an analog video signal is dissected into its red (R), green (G) and blue (B) components 32, 33 and 34, respectively. Each analog component is coupled to an 8-bit analog to digital (A/D) converter 35, 36 and 37, respectively. The analog R, G and B signals are converted to a stream of 8-bit binary signals 35.5, 36.5, 37.5, respectively, which are combined by pixelizer 39 into a stream of 24 bit binary signals, 39.5 each, representing a pixel of the image. A digital color signal having 24 bits is capable of representing one of over 16 million colors. However, the video system on which such a signal is to be displayed might be incapable of displaying the entire spectrum of encoded colors.

Figure 2:
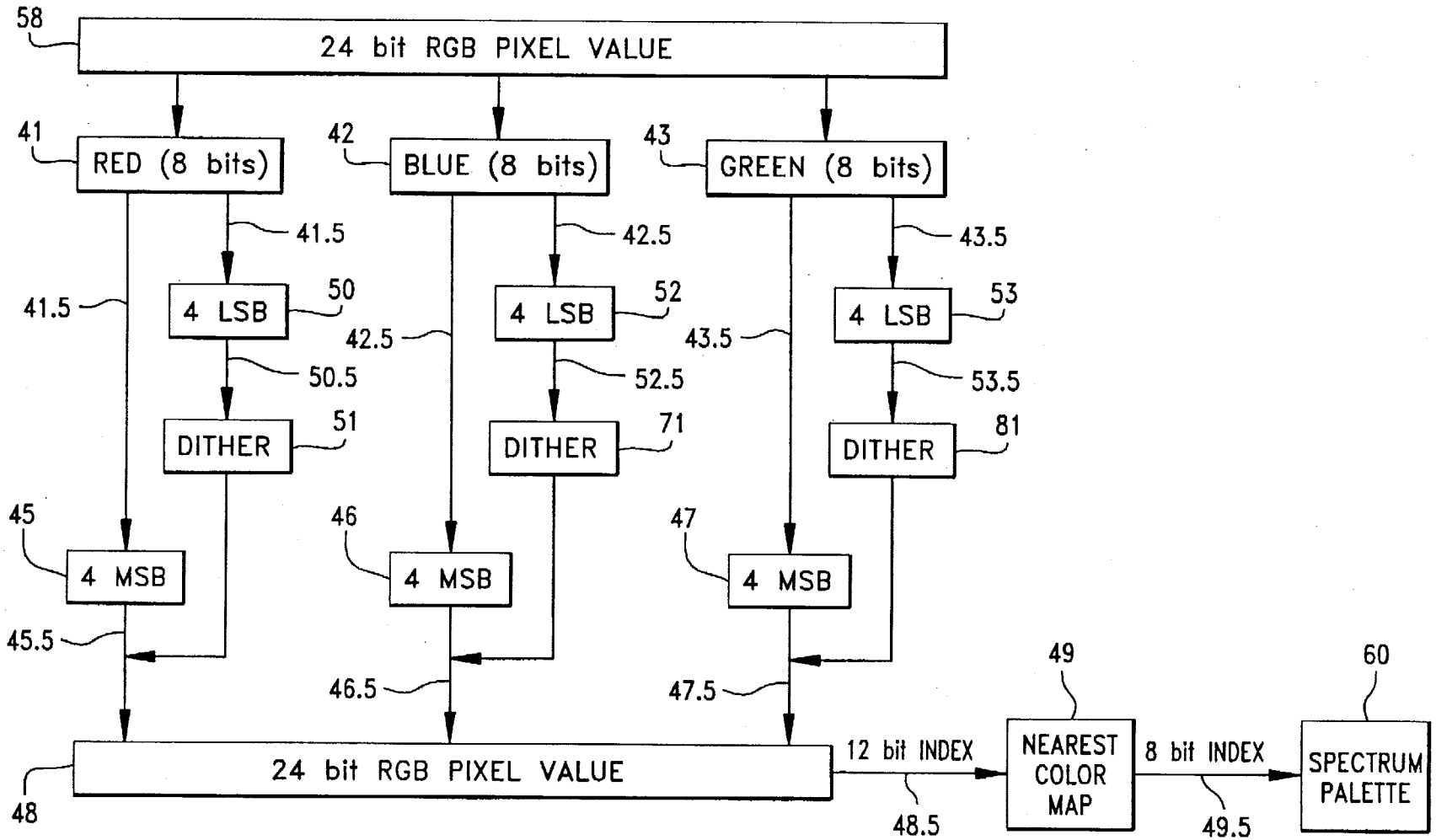
FIG. 2 is a block diagram of a color reduction and conversion apparatus according to an embodiment of the invention.
Figure 3:
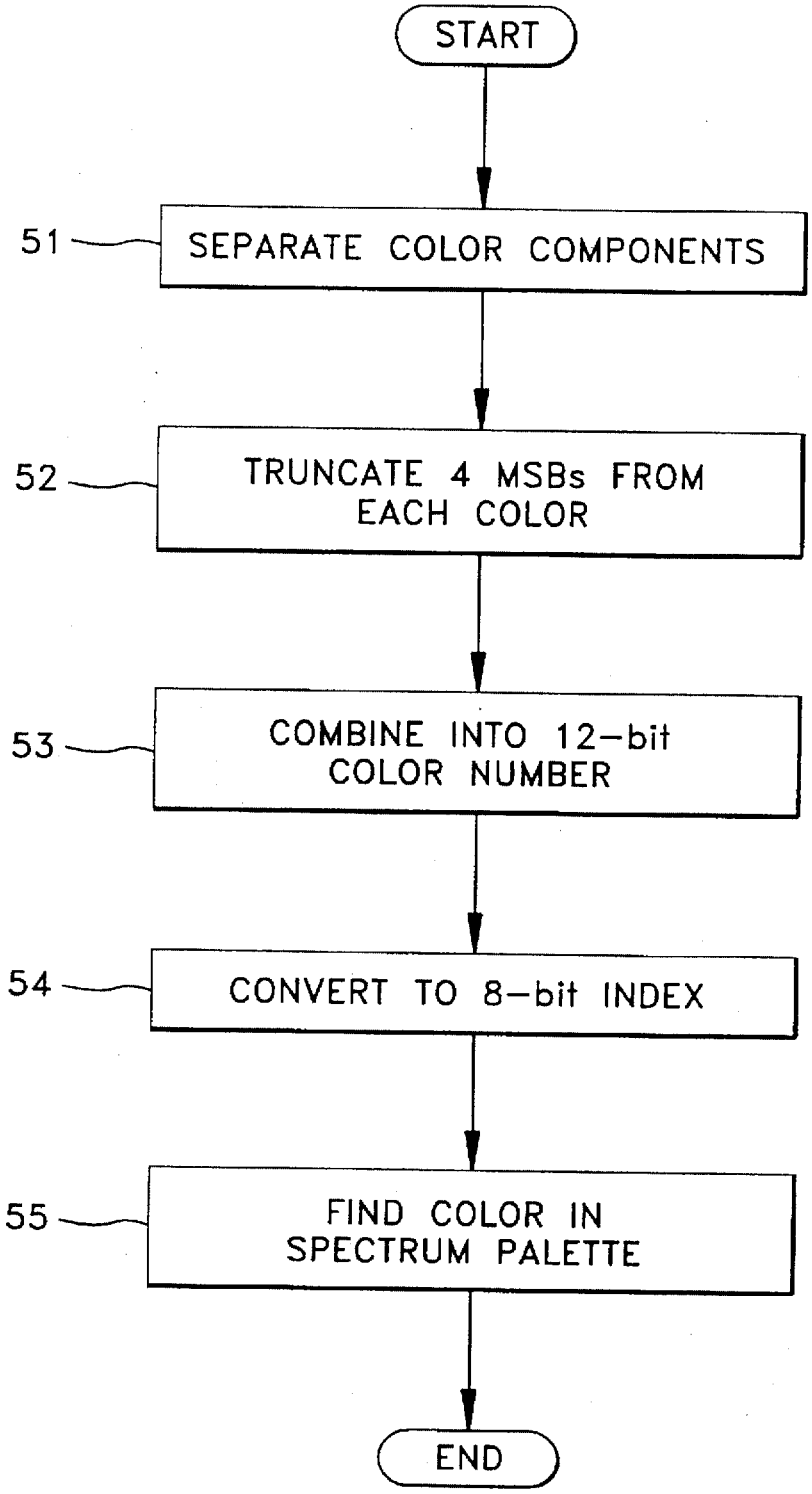
FIG. 3 is a flow chart of one embodiment of the color reduction and conversion of the invention.

Referring now to FIGS. 2 and 3, a 24 bit/pixel RGB digital video signal 58 is reduced and converted by reduction and conversion system 40 for display on a video system capable of displaying, for example, 256 colors. The red, green and blue components of each 24-bit pixel in the video signal are separated by color separators 41–43, respectively (step 51 of FIG. 3). The 8-bit R signal is coupled to most-significant bit truncater 45 which removes from the 8-bit R signal the four most-significant bits (MSBs) i.e., the first four bits from left to right, of the 8-bit R signal. Likewise, the 8-bit B and G signals, 42.5 and 43.5 are coupled to most-significant bit truncaters 46 and 47 which remove the four most-significant bits from the 8-bit B and G color signals, respectively (step 52). The 4 MSBs, 45.5, 46.5, 47.5 from the R, G and B color signals, respectively, are combined by combiner 48 into a 12-bit color number (step 53). The 12-bit color number is a 12-bit index 48.5 to nearest-color map 49.

Nearest-color map 49 includes, in the embodiment shown, 4096 entries. Nearest-color map 49 is a precalculated array that converts 12-bit color number 48.5 into an 8-bit index (step 54), to a specific color in spectrum palette 60. Nearest-color map 49, preferably is generated by software prior to the reduction and conversion operation based on the known parameters of the incoming video signal and the target video display system. The generation of the nearest-color map can occur at load time of the software.

Spectrum palette 60 is a color look-up table accessible, in one embodiment, via the 8-bit index generated by nearest-color map 49. Spectrum palette 60 is a table in which colors capable of being generated by the video system associated with spectrum palette 60 are represented. For example, in this embodiment, spectrum palette would provide 256 colors. Preferably, the 256 colors are distributed evenly through the RGB color space. In other embodiments of the invention, spectrum palette 60 preferably evenly covers the entire available color space, i.e., the number of colors available for display on the video display system in use. In certain software embodiments of the invention, spectrum palette 60 preferably is generated during loading of the program rather than at run-time, since, assuming the video display capabilities of the computer remain the same, color palette 60 will never need to be changed. Color palette 60 and nearest-color map 49, because of their interrelationship, preferably are created by the same program.

In the embodiment shown, the 8-bit index 49.5 generated by nearest-color map 49 accesses a location in spectrum palette 60 containing a color to be used to represent the 24-bit RGB pixel value 58 (step 55). In this embodiment of the invention, the 8-bit indices 49.5 in the nearest-color map 49 are not unique. There are 4096 entries in the nearest-color map which correspond to 256 8-bit indices 49.5. Typically, more than one color map entry will therefore return identical 8-bit indices 49.5 to the spectrum palette.

Figure 4:
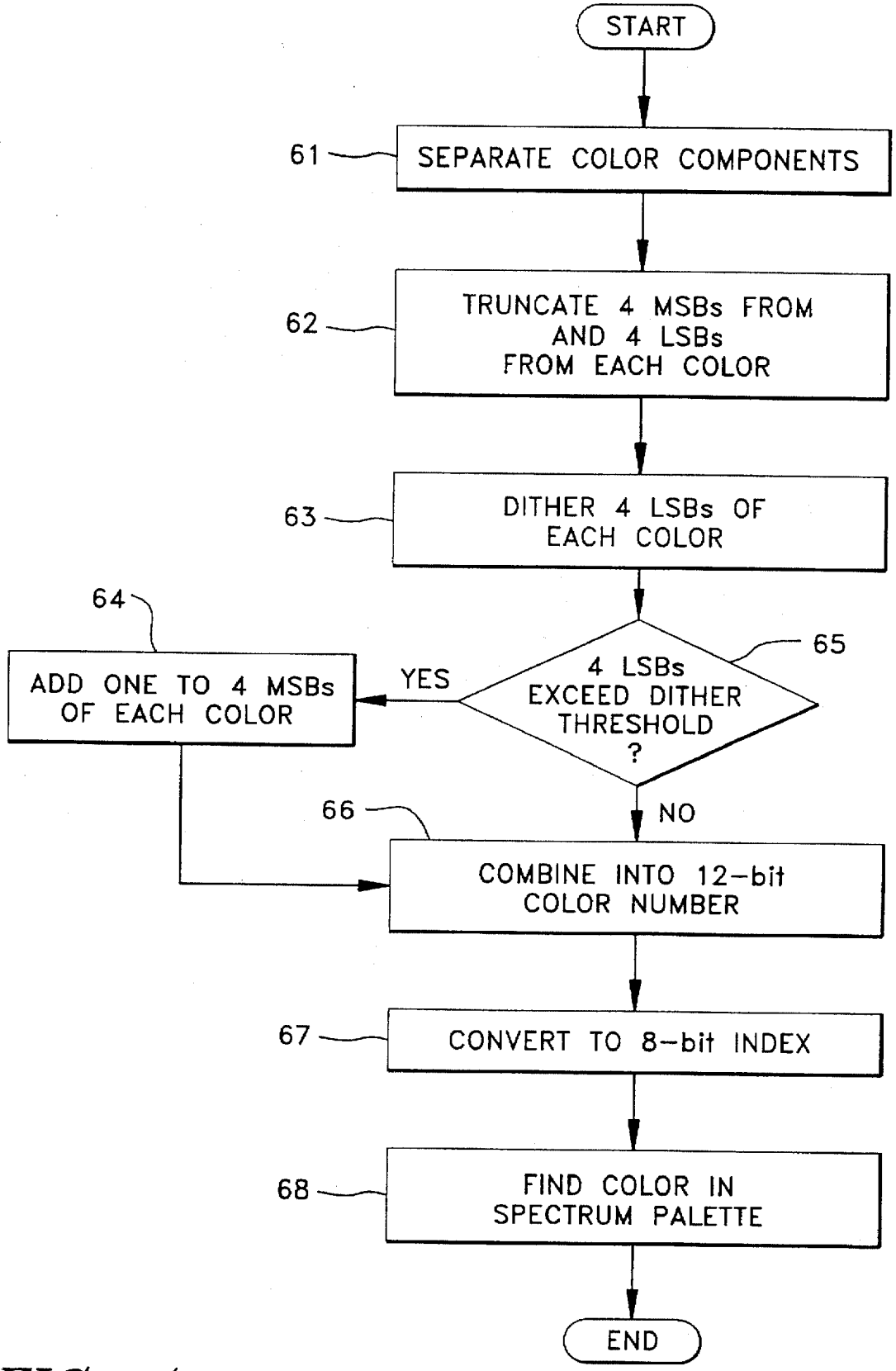
FIG. 4 is a flow chart of another embodiment of the color reduction and conversion of the invention.

In the embodiment shown in FIG. 2 with reference to FIGS. 4 and 5, the 4 least-significant bits (LSBs) for each of the red, green and blue colors are dithered. For example, a 24-bit RGB pixel value 58 of an image being converted for display in accordance with the invention is separated into 8-bit red, green and blue (R,G,B) components by color separators 41–43, respectively. (Step 61 of FIG. 4.) Each 8-bit color component is split into its 4 most-significant and least-significant bits by MSB truncaters 45, 46 and 47 and LSB truncaters 50, 52 and 53 (step 62). The 4 LSBs of each color R, G and B are dithered by ditherers 51, 71 and 81, respectively (step 63). Dithering using any of ditherers 51, 71 or 81 involves comparing the value of the subject 4 LSBs to a predetermined threshold value. The threshold value corresponds to the particular location in the image of the subject pixel. If the value of the 4 LSBs exceeds the threshold (step 65), one is added to the 4 MSBs (step 64). For example, when dithering the 4 LSBs 50.5 of the R component 41.5 of pixel 58 using ditherer 51 in FIG. 2, one is added to the value of the 4 MSBs 45.5 if the 4 LSBs 50.5 are greater than the threshold value. Adding a one to any of the 4 MSBs 45.5, 46.5 or 47.5 will affect 12-bit color number 48 and possibly the 8-bit index from nearest-color map 49 which corresponds to the pixel color accessed from spectrum palette 60, causing, for example, a different pixel color to be accessed from spectrum palette 60. For example, if R LSB value 50.5 exceeds the threshold value used by ditherer 51, 12-bit color number 48 and consequently 8-bit index 49.5 could be affected such that a pixel color having a brighter red component, for example, is accessed from spectrum palette 60. In an embodiment, if the four MSBs of a color are at a maximum value, e.g., are at binary 1111, nothing will be added to the bits even if the corresponding 4 LSBs exceed the threshold value.

If the value of 4 LSBs 50.5 of 8-bit R color component 41.5 does not exceed the threshold value in ditherer 51 (step 65), nothing is added to the value of the 4 MSBs 45.5. After the 4 LSBs 52.5 and 53.5 of B component 42.5 and G component 43.5 also are dithered, the resultant 12 bits are combined by combiner 48 into 12-bit color number 48.5 in the manner described above (step 66). Also as described above, 12-bit index 48.5 is used to select from nearest-color map 49 an 8-bit index 49.5 (step 67) used to access a color in spectrum palette 60 (step 68).

In an embodiment, the particular threshold value used by ditherers 51, 71 and 81 is identical for each pixel spot, i.e., for each of the LSBs 50.5, 52.5 and 53.5 of the various color components 41.5, 42.5 and 43.5 of a pixel 58. Alternatively, ditherers 51, 71 and 81 could use relatively different threshold values when dithering the LSBs 50.5, 52.5 and 53.5 of the various color components of a single pixel.

The dithering process serves to fine-tune a pixel color and can considerably increase image quality. In an embodiment of the invention, as shown in FIG. 5*a*, the thresholds are stored in dither table 71, which is a 4×4 array having 16 threshold values A–P. Dither table 71 is, for example "overlaid" over the matrix of pixel values defining an image, for example, pixel image matrix 72 having the dimensions of $x_n$ by $y_n$ shown in FIG. 5*b*.

As shown in FIG. 5*b*, the threshold value of A preferably is used when dithering the LSBs of the color components in pixel location $x_1$, $y_1$. Threshold value B is used for the pixel location $x_2$, $y_1$. This match up continues as shown if FIG. 5*b* throughout the corresponding positions of the pixels in pixel image matrix 72 with the threshold values in overlaid dither table 71. In an embodiment of the invention shown in FIG. 5*b*, the same dither table 71 is used for dithering adjacent 4×4 blocks of pixels in pixel image matrix 72.

In the embodiment above, each position in dither table 71, for example A or B, has a single threshold value stored therein. In other embodiments of the invention, each position can have more than one threshold value, e.g., one for each color component of the corresponding pixel being dithered.

The present invention can be embodied in the form of computer-implemented processes and apparatuses for practicing those processes. The present invention also can be embodied in the form of computer program code embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention.

A particular embodiment of the invention is shown and described above. Further embodiments are possible. For example, conversion of an RGB color signal is shown. However, the invention also can convert color signals which are in the YUV or YIQ formats. Also, the pixel component size is not limited to 8-bits, and the invention may be used to convert pixel components having more or less data. Relatedly, the nearest color table need not be limited to 4096 index spaces and can have more or less, preferably depending on the particular size of the color number generated. The color palette also may have a number of colors different than the 256 colors described in the embodiment above; however, the color table size is usually dependent on the capabilities of the target video system.

Furthermore, it should be understood that various changes in the details, materials, and arrangements of the parts which have been described and illustrated in order to explain the nature of this invention may be made by those skilled in the art without departing from the principle and scope of the invention as expressed in the following claims.

What I claim is:

1. A computer-implemented method for converting a color image composed of color pixels, comprising the steps of:

(a) receiving components of a color pixel of the color image;

(b) truncating most-significant bits from each component of the color pixel;

(c) combining the most-significant truncated bits to form a color number, the color number representing an index to a nearest-color map;

(d) generating an index to a color palette using the nearest-color map index, the color palette containing a plurality of colors; and (e) accessing one of the plurality of colors to represent the color pixel using the color palette index.

2. The method of claim 1, wherein step (b) leaves a remainder of least-significant bits from each component of the pixel and further comprising before step (c) the steps of:

comparing the remainder of least-significant bits from each pixel component to a predetermined threshold value; and adding 1 to the most-significant bits of any pixel component in which the remainder of least-significant bits for that component exceeds the threshold value.

3. The method of claim 1, wherein the nearest-color map is a table containing the color palette index and step (d) comprises the step of using the nearest-color map index to look-up the color palette index in the table.

4. The method of claim 3, wherein the color palette is a table containing the colors and step (e) comprises the step of using the color palette index to look-up the color in the color palette.

5. The method of claim 4, further comprising the step of generating the nearest-color map and color palette using known configurations of the color image and a graphics system of the computer.

6. The method of claim 1, wherein step (a) further comprises the steps of:

(i) separating the components of the color pixel; and (ii) converting the components to digital signals.

7. The method of claim 1, wherein the components of the color pixel are red, green and blue color components.

8. The method of claim 7, wherein each color component is comprised of 8-bits.

9. The method of claim 8, wherein step (b) comprises the step of:

truncating four (4) most-significant bits from each 8-bit color component;

and step (c) comprises the step of:

combining the most-significant bits into a 12-bit color number.

10. The method of claim 9, wherein step (d) comprises the step of:

using the 12-bit color number to access a 4096 entry nearest-color map containing the color palette index.

11. The method of claim 10, wherein the palette contains 256 colors.

12. The method of claim 2, wherein the threshold is identical for each pixel component.

13. The method of claim 2, wherein there are a set of threshold values and a plurality of color pixels having pixel components and the step of comparing comprises:

repeatedly using the set of threshold values to compare with the remainder of least-significant bits from the pixel components of the plurality of color pixels.

14. The method of claim 1, wherein the color number is $2^n$ and the color palette has $2^m$ entries, where n and m are integers and n is greater than or equal to m.

15. An apparatus for converting a color image composed of color pixels, comprising:

(a) means for receiving components of a color pixel of the color image;

(b) means for truncating most-significant bits from each component of the color pixel;

(c) means for combining the most-significant truncated bits to form a color number, the color number representing an index to a nearest-color map;

(d) means for generating an index to a color palette using the nearest-color map index, the color palette containing a plurality of colors; and (e) means for accessing one of the plurality of colors to represent the color pixel using the color palette index.

16. The apparatus of claim 15, wherein means (b) leaves a remainder of least-significant bits from each component of the pixel and further comprising:

means for comparing the remainder of least-significant bits from each pixel component to a predetermined threshold value; and means for adding 1 to the most-significant bits of any pixel component in which the remainder of least-significant bits for that component exceeds the threshold value.

17. The apparatus of claim 15, wherein the nearest-color map is a table containing the color palette index and means (d) uses the nearest-color map index to look-up the color palette index in the table.

18. The apparatus of claim 17, wherein the color palette is a table containing the colors and means (e) uses the color palette index to look-up the color in the color palette.

19. The apparatus of claim 18, further comprising means for generating the nearest-color map and color palette using known configurations of the color image and a graphics system of the computer.

20. The apparatus of claim 15, wherein means (a):

(i) separates the components of the color pixel; and (ii) converts the components to digital signals.

21. The apparatus of claim 15, wherein the components of the color pixel are red, green and blue color components.

22. The apparatus of claim 21, wherein each color component is comprised of 8-bits.

23. The apparatus of claim 22, wherein means (b):

truncates four (4) most-significant bits from each 8-bit color component;

and means (c):

combines the most-significant bits into a 12-bit color number.

24. The apparatus of claim 23, wherein means (d):

uses the 12-bit color number to access a 4096 entry nearest-color map containing the color palette index.

25. The apparatus of claim 24, wherein the palette contains 256 colors.

26. The apparatus of claim 16, wherein the threshold is identical for each pixel component.

27. The apparatus of claim 16, wherein there are a set of threshold values and a plurality of color pixels having pixel components and the means for comparing:

repeatedly uses the set of threshold values to compare with the remainder of least-significant bits from the pixel components of the plurality of color pixels.

28. The apparatus of claim 15, wherein the color number is $2^n$ and the color palette has $2^m$ entries, where n and m are integers and n is greater than or equal to m.

29. A storage medium encoded with machine-readable computer program code for converting a color image composed of color pixels, comprising:

(a) means for causing a computer to receive components of a color pixel of the color image;

(b) means for causing the computer to truncate most-significant bits from each component of the color pixel;

(c) means for causing the computer to combine the most-significant truncated bits to form a color number, the color number representing an index to a nearest-color map;

(d) means for causing the computer to generate an index to a color palette using the nearest-color map index, the color palette containing a plurality of colors; and (e) means for causing the computer to access one of the plurality of colors to represent the color pixel using the color palette index.

30. The storage medium of claim 29, wherein means (b) causes the computer to leave a remainder of least-significant bits from each component of the pixel and further comprising:

means for causing the computer to compare the remainder of least-significant bits from each pixel component to a predetermined threshold value; and means for causing the computer to add 1 to the most-significant bits of any pixel component in which the remainder of least-significant bits for that component exceeds the threshold value.

31. The storage medium of claim 29, wherein the nearest-color map is a table containing the color palette index and means (d) causes the computer to use the nearest-color map index to look-up the color palette index in the table.

32. The storage medium of claim 31, wherein the color palette is a table containing the colors and means (e) causes the computer to use the color palette index to look-up the color in the color palette.

33. The storage medium claim 32, further comprising means for causing the computer to generate the nearest-color map and color palette using known configurations of the color image and a graphics system of the computer.

34. The storage medium of claim 29, wherein means (a):

(i) causes the computer to separate the components of the color pixel; and (ii) causes the computer to convert the components to digital signals.

35. The storage medium of claim 29, wherein the components of the color pixel are red, green and blue cored, green and blue color components.

36. The storage medium of claim 35, wherein each color component is comprised of 8-bits.

37. The storage medium of claim 36, wherein means (b):

causes the computer to truncate four (4) most-significant bits from each 8-bit color component;

and means (c):

causes the computer to combine the most-significant bits into a 12-bit color number.

38. The storage medium of claim 37, wherein means (d):

causes the computer to use the 12-bit color number to access a 4096 entry nearest-color map containing the color palette index.

39. The storage medium of claim 38, wherein the palette contains 256 colors.

40. The storage medium of claim 30, wherein the threshold is identical for each pixel component.

41. The storage medium of claim 30, wherein there are a set of threshold values and a plurality of color pixels having pixel components and the means for causing the computer to compare:

repeatedly uses the set of threshold values to compare with the remainder of least-significant bits from the pixel components of the plurality of color pixels.

42. The storage medium of claim 29, wherein the color number is $2^n$ and the color palette has $2^m$ entries, where n and m are integers and n is greater than or equal to m.

* * * * *

UNITED STATES PATENT AND TRADEMARK OFFICE

CERTIFICATE OF CORRECTION

| | | |
|---|---|---|
| PATENT NO. | : | 5,673,065 |
| DATED | : | September 30, 1997 |
| INVENTOR(S) | : | William C. DeLeeuw |

It is certified that error appears in the above-identified patent and that said Letters Patent is hereby corrected as shown below:

Column 8, line 9, delete "cored," ;

Column 8, line 10, delete "green and blue"

Signed and Sealed this

Tenth Day of February, 1998

*Attest:*

Bruce Lehman

BRUCE LEHMAN

*Attesting Officer*

*Commissioner of Patents and Trademarks*